US011008824B2

(12) United States Patent
Al-Mousa et al.

(10) Patent No.: US 11,008,824 B2
(45) Date of Patent: May 18, 2021

(54) VERTICALLY CUTTING DOWNHOLE TUBULARS

(71) Applicant: Saudi Arabian Oil Company, Dhahran (SA)

(72) Inventors: Ahmed Al-Mousa, Dhahran (SA); Ahmed A. Al-Ramadhan, Dhahran (SA); Marius Neacsu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/546,107

(22) Filed: Aug. 20, 2019

(65) Prior Publication Data

US 2021/0054706 A1 Feb. 25, 2021

(51) Int. Cl.

| | |
|---|---|
| ***E21B 29/06*** | (2006.01) |
| ***E21B 43/112*** | (2006.01) |
| ***E21B 31/16*** | (2006.01) |
| ***E21B 29/00*** | (2006.01) |
| *E21B 31/20* | (2006.01) |

(52) U.S. Cl.
CPC ..... *E21B 29/005* (2013.01); *E21B 31/16* (2013.01); *E21B 31/20* (2013.01)

(58) Field of Classification Search
CPC ..... E21B 29/005; E21B 29/06; E21B 29/002; E21B 43/112; E21B 31/16
See application file for complete search history.

(56) References Cited

U.S. PATENT DOCUMENTS

| | | | | |
|---|---|---|---|---|
| 1,789,993 A | | 1/1931 | Switzer | |
| 2,304,793 A | | 12/1942 | Bodine | |
| 3,225,828 A | | 12/1965 | Wisenbaker et al. | |
| 4,042,019 A | | 8/1977 | Henning | |
| 5,899,796 A | * | 5/1999 | Kamiyama | E21B 29/06 166/55.7 |
| 6,070,665 A | * | 6/2000 | Singleton | E21B 7/061 166/242.1 |

(Continued)

FOREIGN PATENT DOCUMENTS

| | | |
|---|---|---|
| WO | 2012164023 | 12/2012 |
| WO | WO 2015112022 | 7/2015 |
| WO | WO 2016011085 | 1/2016 |

OTHER PUBLICATIONS

PCT International Search Report and Written Opinion in International Appln. No. PCT/US2020/046818, dated Nov. 30, 2020, 14 pages.

*Primary Examiner* — Cathleen R Hutchins
(74) *Attorney, Agent, or Firm* — Fish & Richardson P.C.

(57) ABSTRACT

A cutting assembly is housed within a main body. The cutting assembly includes a rotary blade mounted vertically within the main body. A blade motor is coupled to the rotary blade. The blade motor is configured to rotate the rotary blade with sufficient speed and torque to cut through a wellbore tubular. The blade motor is supported by a blade motor mount. A lead screw is coupled to the blade motor mount. The lead screw is rotatable to control a vertical position of the rotary blade. A lead screw motor is rotably coupled to the lead screw. The lead screw motor is configured to rotate the lead screw to adjust the vertical position of the rotary blade. A guide is located within the main body. The guide includes a profile that controls a horizontal position of the blade based on the vertical position of the rotary blade.

20 Claims, 5 Drawing Sheets

(56) References Cited

U.S. PATENT DOCUMENTS

| | | | | |
|---|---|---|---|---|
| 8,210,251 | B2 | 7/2012 | Lynde et al. | |
| 2009/0250220 | A1 | 10/2009 | Stamoulis | |
| 2010/0258289 | A1* | 10/2010 | Lynde ..... | E21B 37/02 166/55.7 |
| 2014/0138091 | A1 | 5/2014 | Fuhst | |

* cited by examiner

VERTICALLY CUTTING DOWNHOLE TUBULARS

TECHNICAL FIELD

This disclosure relates to wellbore tools.

BACKGROUND

Production and injection wellbores include downhole tubulars. Such tubulars include production/injection tubing, casing, liners, and many other types of downhole tubulars. In some instances, a downhole tubular must be removed. While some downhole tubulars are designed for easy removal, such tubulars can still become stuck on occasion. In such instances, the tubulars are often severed or milled to remove the stuck tubular.

SUMMARY

This disclosure relates to vertically cutting downhole tubulars.

An example implementation of the subject matter described with this disclosures is a wellbore tool with the following features. A main body that has a diameter such that the main body can be inserted into a wellbore. A cutting assembly is housed within the main body. The cutting assembly includes a rotary blade mounted vertically within the main body. A blade motor is coupled to the rotary blade. The blade motor is configured to rotate the rotary blade with sufficient speed and torque to cut through a wellbore tubular. The blade motor is supported by a blade motor mount. A lead screw is coupled to the blade motor mount. The blade motor mount defines a mating profile to receive the lead screw. The profile includes an interference in a vertical direction to support the blade motor mount to the lead screw. The lead screw is rotatable to control a vertical position of the rotary blade. A lead screw motor is rotably coupled to the lead screw. The lead screw motor is configured to rotate the lead screw to adjust the vertical position of the rotary blade. A guide is located within the main body. The guide includes a profile that controls a horizontal position of the blade based on the vertical position of the rotary blade.

Aspects of the example implementation, which can be combined with the example implementation alone or in combination, include the following. The blade motor and the lead screw motor are electric motors.

Aspects of the example implementation, which can be combined with the example implementation alone or in combination, include the following. A speed of the rotary blade and rotary blade motor are configured to perform a cold-cut on carbon steel.

Aspects of the example implementation, which can be combined with the example implementation alone or in combination, include the following. The wellbore tool is powered by an e-line running between the main body and a topside facility.

Aspects of the example implementation, which can be combined with the example implementation alone or in combination, include the following. The profile substantially includes a trapezoidal shape.

Aspects of the example implementation, which can be combined with the example implementation alone or in combination, include the following. Actuable slips are positioned at an end of the main body. The actuable slips are configured to centralize and support the main body when in an extended state.

An example implementation of the subject matter described within this disclosure is a method with the following features. A wellbore tool is received by a downhole tubular. The wellbore tool includes a rotary blade. The rotary blade is rotated by the wellbore tool. The rotary blade is extended from the wellbore tool. The rotary blade is extended sufficiently to cut through the downhole tubular. The tubular is cut through.

Aspects of the example implementation, which can be combined with the example implementation alone or in combination, include the following. The rotary blade is translated vertically while cutting through the tubular.

Aspects of the example implementation, which can be combined with the example implementation alone or in combination, include the following. Translating the rotary blade vertically includes translating the rotary blade in an uphole direction.

Aspects of the example implementation, which can be combined with the example implementation alone or in combination, include the following. Translating the rotary blade vertically includes cycling the rotary blade in an uphole and downhole direction.

Aspects of the example implementation, which can be combined with the example implementation alone or in combination, include the following. The rotary blade is retracted into the wellbore tool. The rotary blade ceases rotating. The wellbore tool is retrieved from the downhole tubular.

Aspects of the example implementation, which can be combined with the example implementation alone or in combination, include the following. Power is received by the wellbore tool from a topside facility.

Aspects of the example implementation, which can be combined with the example implementation alone or in combination, include the following. Receiving the wellbore tool includes pulling the wellbore tool into the downhole tubular by an electric wellbore tractor.

Aspects of the example implementation, which can be combined with the example implementation alone or in combination, include the following. The wellbore is a horizontal or deviated wellbore.

Aspects of the example implementation, which can be combined with the example implementation alone or in combination, include the following. The wellbore tool and the electric wellbore tractor are retrieved from the wellbore.

Aspects of the example implementation, which can be combined with the example implementation alone or in combination, include the following. The tubular includes a seal stinger.

Aspects of the example implementation, which can be combined with the example implementation alone or in combination, include the following. The seal stinger is removed from the wellbore.

Aspects of the example implementation, which can be combined with the example implementation alone or in combination, include the following. The wellbore tool is centralized and supported by actuating actuable slips.

An example implementation of the subject matter described within this disclosure is a wellbore tool system with the following features. A main body is configured to be inserted into a wellbore. An e-line connects the main body to a topside facility. The e-line is configured to transfer power between the main body and the topside facility. A cutting assembly is housed within the main body. The cutting assembly includes a rotary blade arranged to produce vertical cuts. A lead screw is coupled to the rotary blade. The lead screw controls a vertical position of the rotary blade. An electric blade motor is coupled to the rotary blade. The blade motor is configured to rotate the rotary blade with sufficient speed and torque to cut through a wellbore tubular. The electric blade motor is configured to receive power through the e-line. An electric lead screw motor is coupled to the lead screw. The lead screw motor is configured to rotate the lead screw to adjust the vertical position of the rotary blade. The electric lead screw motor is configured to receive power through the e-line. A guide is located within the main body. The guide includes a profile that controls a horizontal position of the rotary blade based on the vertical position of the rotary blade.

Aspects of the example implementation, which can be combined with the example implementation alone or in combination, include the following. An electric tractor is connected to a downhole end of the main body. The electric tractor is configured to receive power through the e-line.

Particular implementations of the subject matter described in this specification can be implemented so as to realize one or more of the following advantages. Rig time is reduced as the cutting process is completed in a single run. The lack of chemicals and explosives improves the tools safety in comparison to other methods.

The details of one or more implementations of the subject matter described in this specification are set forth in the accompanying drawings and description. Other features, aspects, and advantages of the subject matter will become apparent from the description, the drawings, and the claims.

BRIEF DESCRIPTION OF THE DRAWINGS

FIGS. 5A-5E are side cross-sectional views of the example downhole tool at various stages of cutting a downhole tubular.

Like reference numbers and designations in the various drawings indicate like elements.

DETAILED DESCRIPTION

Certain downhole tubulars can be configured to mate together for easy insertion and removal. An example of such a configuration can include a seal stinger and a Polished Bore Receptacle (PBR). The seal stinger includes a tapered tubular with a diameter less than that of the PBR. The seal stinger is inserted, or stung, into the PBR to form a continuous flow passage. The seal stinger includes one or more seals around the seal stinger's outer circumference to prevent leakage out of the flow passage. While stingers are often used to account for thermal expansion, or are used for temporary well work, they can occasionally become stuck within the PBR.

This disclosure describes a downhole longitudinal cutting device capable of being launched with an e-line. The cutting device includes a rotary cutting blade arranged longitudinally within the device. In operation, the rotary cutting blade rotates and moves along a guide internal to the device. The track directs the rotary cutting blade to protrude from the cutting device, travel a distance longitudinally across the tool, and retract within the tool. The rotary cutting blade is powered by a motor, and movement along the guide is facilitated by a screw or worm gear being turned by a separate motor. The longitudinal movement allows the rotary cutting blade to make a longitudinal cut in a tubular in which the cutting device resides.

Figure 1:
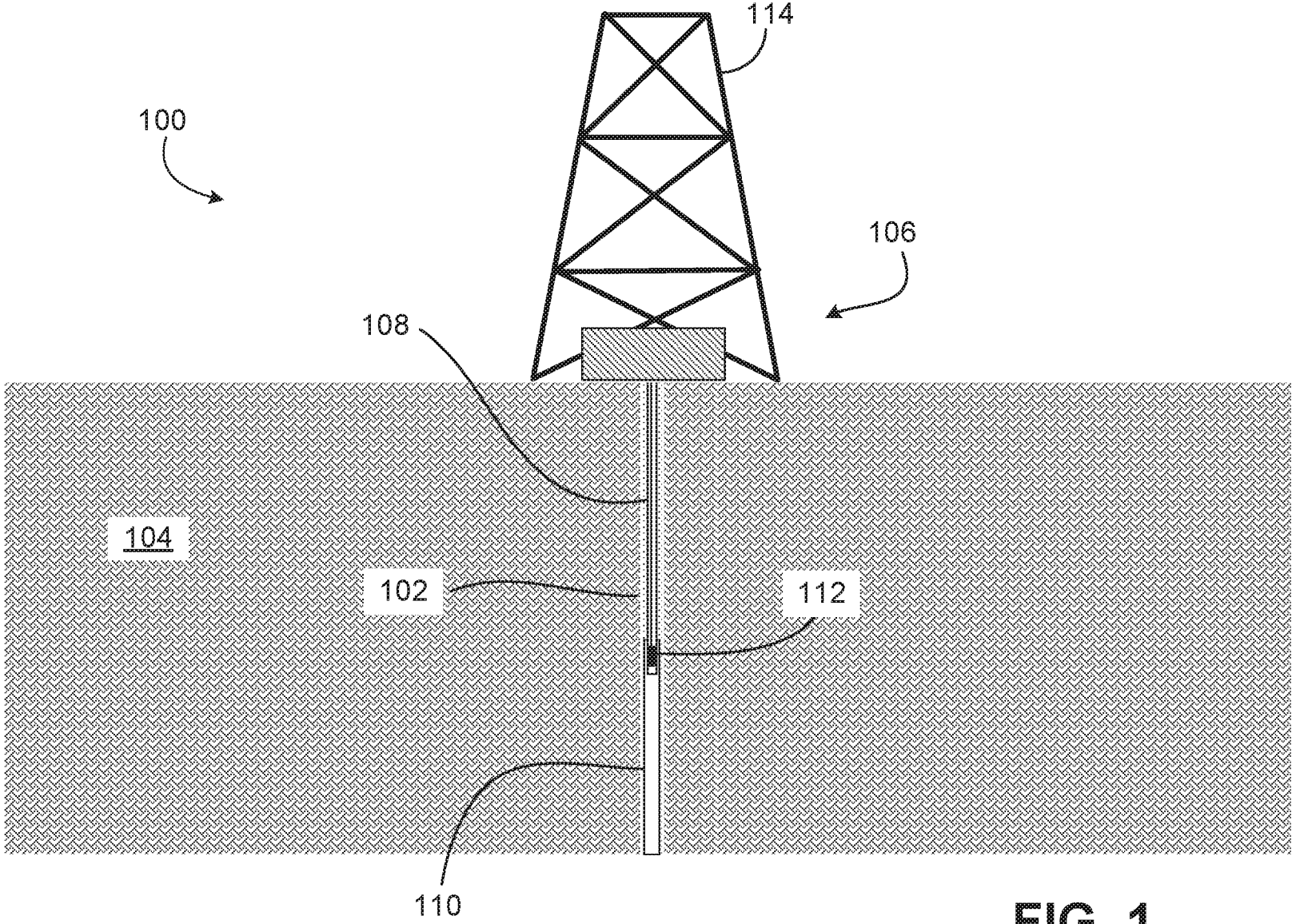
FIG. 1 is a side cross-sectional diagram of an example wellsite.

FIG. 1 is a side cross-sectional diagram of an example wellsite 100. The wellsite 100 includes a wellbore 102 formed within a geologic formation 104. Atop the wellbore is a topside facility 106 that can include pumps, valves, pressure vessels, drawworks, lubricators, and any other production, drilling, or workover equipment. There is a first tubular 108 and a second tubular 110 located within the wellbore. The first tubular 108 or the second tubular 110 can include a liner, casing, drill pipe, production tubing, or any other downhole tubular. As illustrated, the first tubular 108 is inserted into the second tubular 110. Such an arrangement is common in a number of wellbores and can include a stinger stabbed into a PBR. As illustrated, a wellbore tool 112 has been lowered to the depth of the interface between the first tubular 108 and the second tubular 110. The wellbore tool 112 is supported by an e-line or wireline.

While illustrated as a vertical wellbore, wellbore 100 can be a vertical wellbore, a deviated wellbore, or a horizontal wellbore without departing from this disclosure. In some implementations, a wellbore tractor can be used to assist the wellbore tool in reaching its intended destination. Throughout the disclosure, terms such as "horizontal" and "vertical" are used in relation to the wellbore as a central axis. That is, "vertical" is used in reference to an uphole or downhole direction within the wellbore while "horizontal" is perpendicular to an uphole or downhole direction. While illustrated with a drilling derrick 114, the wellbore tool 112 described herein can be deployed with other equipment, such as a wireline or e-line truck.

Figures 2B, 2C, 2D, 2E:
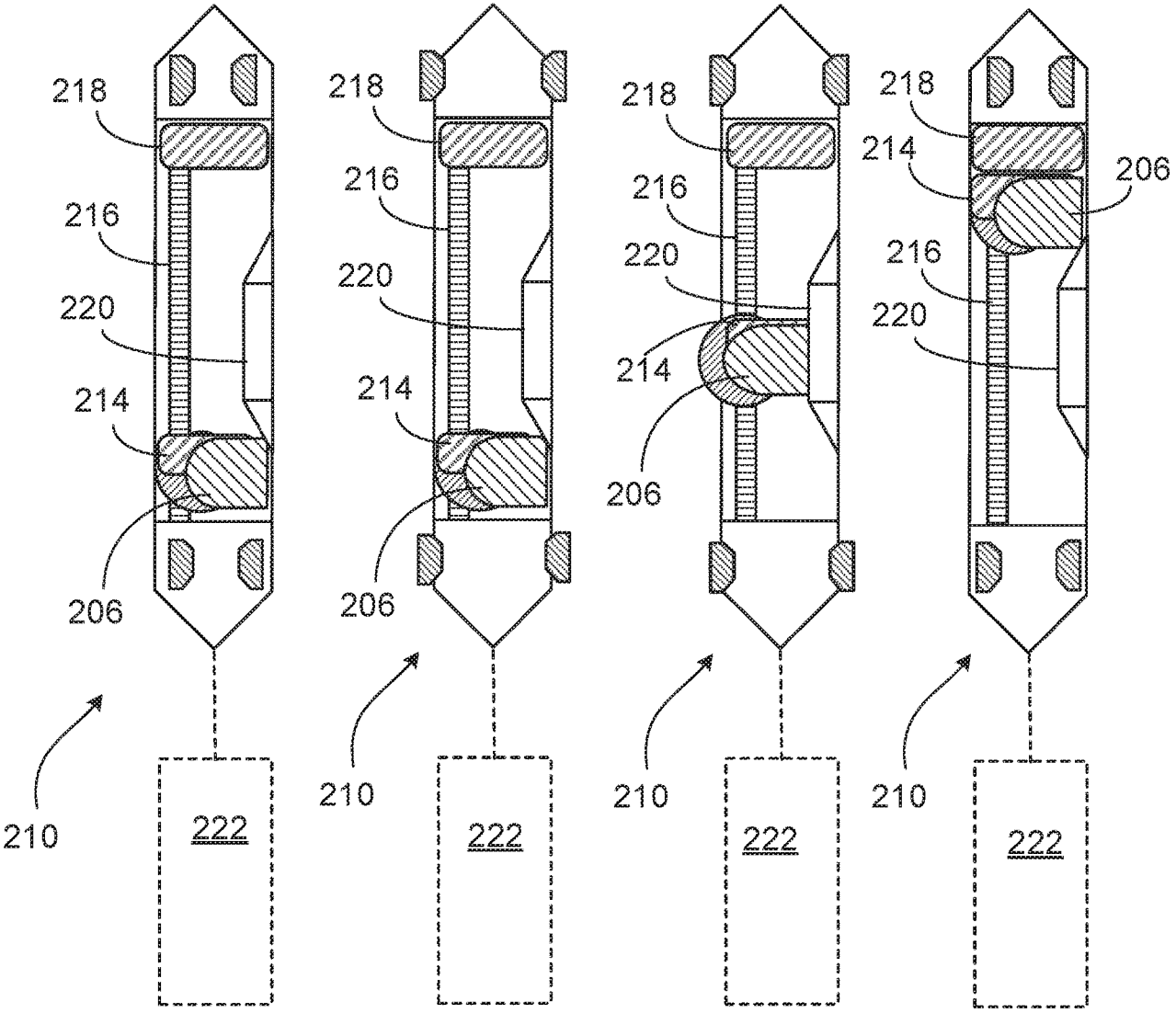
FIGS. 2B-2E are side cross-sectional views of the example downhole tool in various stages of operation.
Figure 2A:
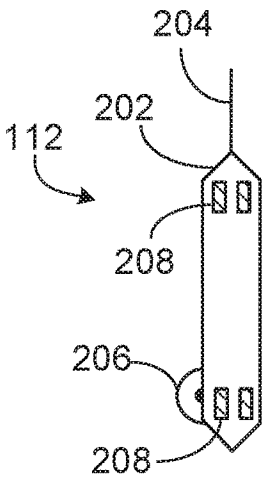
FIG. 2A is a side-view diagram of an example downhole tool.

FIG. 2A is a side-view diagram of an example wellbore tool 112. The wellbore tool 112 includes a main body 202 having a diameter such that the main body 202 can be inserted into a wellbore 102. The main body 202 is supported from an uphole end by an e-line or wireline 204. In some implementations, the wellbore tool 112 is powered by an e-line running between the main body 202 and the topside facility 106 (FIG. 1). In some implementations, all or a portion of the tool can be powered by batteries. Such implementations can include batteries within the main body 202 or elsewhere. The wellbore tool 112 includes a retractable rotary cutting blade 206 that is configured to retract in and out of the main body 202 as well as vertically. Details on the blade mechanism are described throughout this disclosure. The wellbore tool 112 rotates the rotary cutting blade 206 at a speed capable of cold-cutting the tubular. That is, cut through the tubular, or other carbon steel structures within the wellbore 102, without producing sparks. The wellbore tool 112 can also include actuable slips 208 positioned at one or both ends of the main body 202. The actuable slips 208 are retracted within the main body 202 prior to cutting operations, for example, during deployment or retrieval of the wellbore tool 112. The actuable slips 208 are extended just prior to cutting operations and throughout the cutting operations. Once the actuable slips 208 are extended, the actuable slips 208 centralize and support the main body 202 when in an extended state. In general, the slips 208 help prevent further downhole movement of the tool. In some implementations, the slips 208 are similar to liner hanger slips. In the event that the slips 208 cannot be unset for some reason, the wellbore tool 112 can be retrieved by tension in the wireline 204

FIGS. 2B-2E are side cross-sectional views of the example downhole tool in various stages of operation. As illustrated, the wellbore tool 112 includes a cutting assembly 210 housed within the main body 202. The cutting assembly 210 includes the rotary cutting blade 206 mounted vertically within the main body 202. The rotary cutting blade 206 is illustrated in the retracted state in FIGS. 5B-5C and 5E. In some implementations, in the retracted state, the rotary cutting blade 206 is fully enclosed by an outer surface of the main body 202. A blade motor 212 is coupled to the rotary cutting blade 206. The blade motor 212 can be coupled directly to the rotary cutting blade 206, coupled through a gearbox, coupled through a belt drive, or coupled through any other acceptable transmission. The blade motor 212 is configured to rotate the rotary cutting blade 206 with sufficient speed and torque to cut through a wellbore tubular. The blade motor 212 is supported by a motor mount 214. In some implementations, the blade motor 212 can be an electric motor.

A lead screw 216 is coupled to the blade motor base. The blade motor base defines a mating profile that receives the lead screw 216. The profile including an interference in the vertical direction to support the blade motor base to the lead screw 216. For example, the blade motor mount 214 can include a profile similar to the internal threads of a nut. Such threads are configured to engage with the lead screw 216, allowing the lead screw 216 to rotate and change the vertical position of the blade motor mount 214, the blade motor 212, and the rotary cutting blade 206. A lead screw motor 218 is coupled to the lead screw 216. The lead screw motor 218 can be coupled directly to the lead screw 216, coupled through a gearbox, coupled through a belt drive, or coupled through any other acceptable transmission. The lead screw motor 218 is configured to rotate the lead screw 216 to adjust the vertical position of the rotary cutting blade 206. For example, the lead screw motor 218 has sufficient torque to vertically adjust the position of the rotary cutting blade 206 during cutting operations. In some implementations, the lead screw motor 218 can be an electric motor. In some implementations, the lead screw motor 218 can include an encoder to determine a vertical position of the rotary cutting blade 206 based on a number of rotations made by the lead screw motor 218. In some implementations, a separate encoder or position sensor can be used.

A guide 220 is located within the main body 202. The guide 220 defines a profile that controls a horizontal position of the rotary cutting blade 206 based on the vertical position of the rotary cutting blade 206. For example, the profile can be substantially trapezoidal in shape, having a tapered end at both an uphole end and a downhole end of the guide.

Figures 5A, 5B, 5C, 5D, 5F:
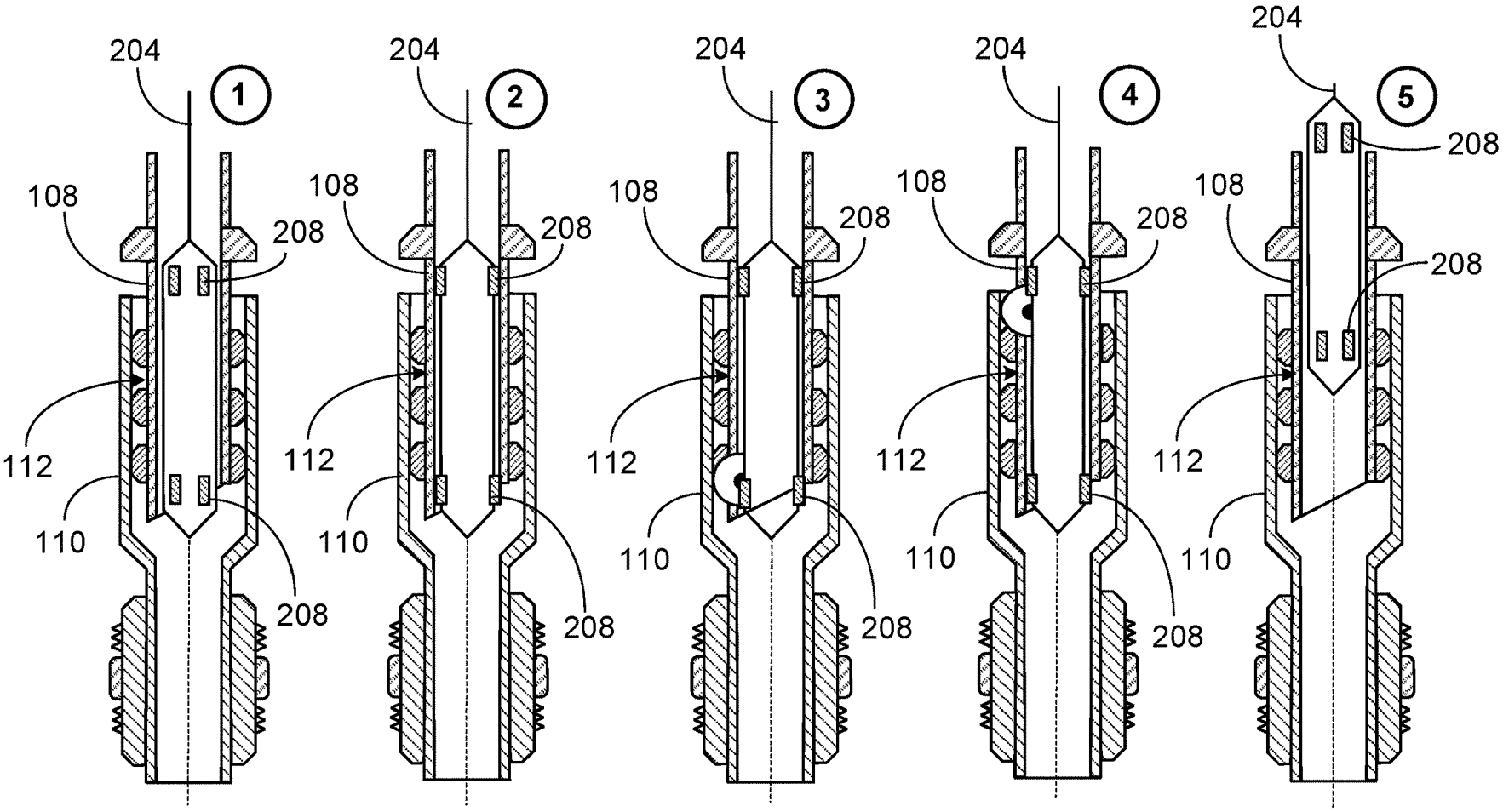

In operation, the blade motor 212 is activated, rotating the rotary cutting blade 206. As the rotary cutting blade 206 rotates, the lead screw motor 218 rotates the lead screw 216, causing the rotary blade motor mount 214, the rotary blade motor 212, and the rotary cutting blade 206, to change a vertical position. The blade motor 212 is attached to the motor mount 214 with a slidable mount, such as a track and notch or pin and slot (not shown), with a bias mechanism (not shown) directing the blade motor 212 towards the guide. In some implementations, the bias mechanism can include a spring. FIG. 5D illustrates the rotary blade motor 212 and rotary cutting blade 206 shifted horizontally by the guide 220 such that the rotary cutting blade 206 extends from the main body 202. As can be seen in FIG. 5C and FIG. 5E, the rotary cutting blade 206 can be in the retracted position at an uphole end or downhole end of the guide 220. Such an arrangement allows for the rotary cutting blade 206 to be used in a single pass and reduces the risk of the wellbore tool 112 getting stuck within the wellbore tubular. While the wellbore tool 112 is primarily described with a roughly trapezoidal shaped guide, other shapes can be used without departing from this disclosure. For example, a curved profile having a flat vertical portion can be used in lieu of a trapezoidal shape.

In some implementations, a wellbore tractor 222 can be connected to a downhole end of the main body 202. In some implementations, the wellbore tractor 222 can be electric and can receive power through the e-line or through internal batteries.

Figure 3B:
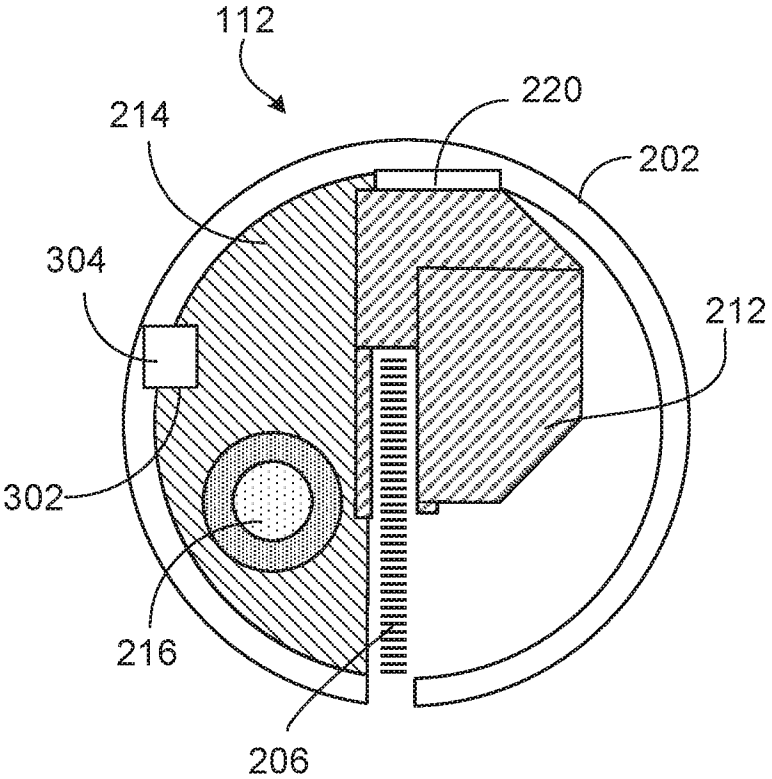
FIGS. 3A-3B are top-down cross-sectional views of the downhole wellbore tool in various stages of operation.
Figure 3A:
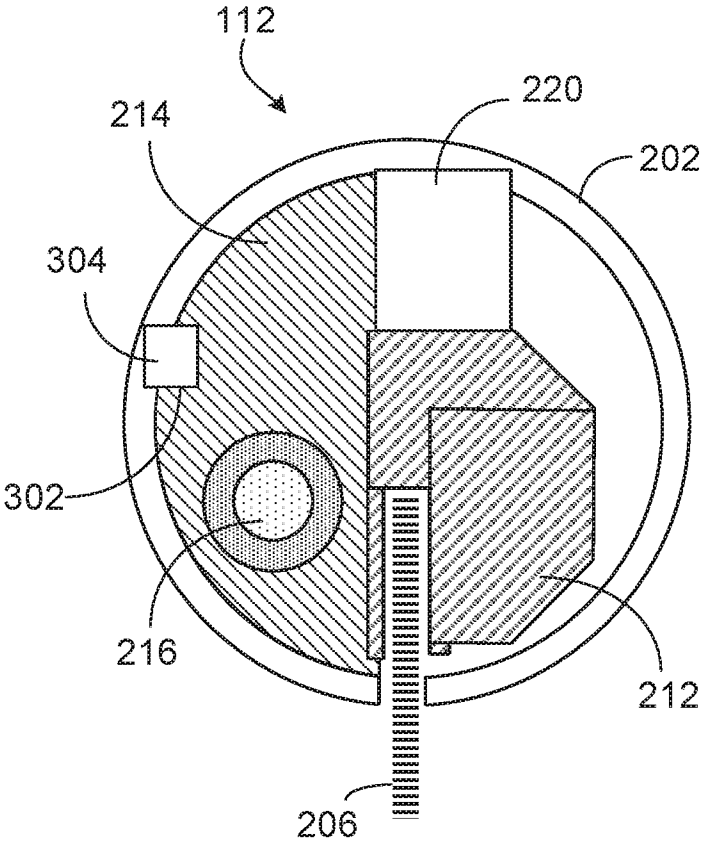

FIGS. 3A-3B are top-down cross-sectional views of the downhole wellbore tool 112 in various stages of operation. FIG. 3A illustrates the rotary cutting blade 206 in the extended position, such as during cutting operations. FIG. 3B illustrates the rotary cutting blade 206 in the retracted position, such as when the wellbore tool 112 is tripping into or out of the wellbore 102. The rotary blade motor mount 214 defines a groove 302 configured to receive a longitudinal notch 304 defined by an interior surface of the main body 202. The mating of the groove 302 and longitudinal notch 304 helps prevent rotation of the rotary motor mount 214 as the lead screw 216 rotates.

Figure 4:
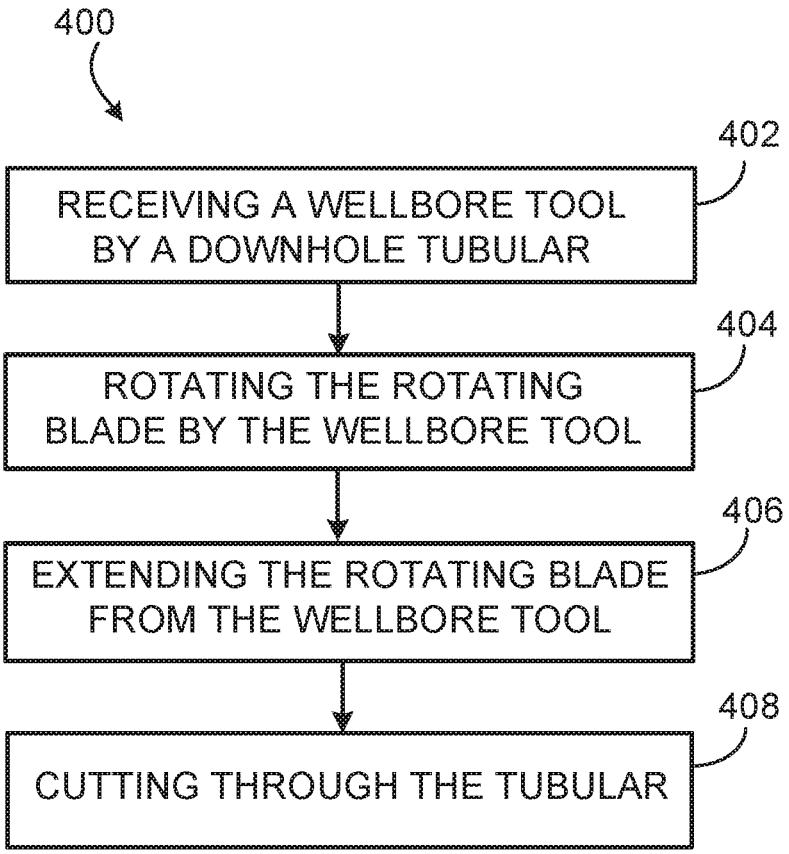
FIG. 4 is a flowchart of an example method that can be used with aspects of this disclosure.

FIG. 4 is a flowchart of an example method 400 that can be used with aspects of this disclosure. The method 400 of FIG. 4 is explained in conjunction with FIGS. 5A-5E, which illustrate side cross-sectional views of the example wellbore tool 112 at various stages of cutting a downhole tubular. The steps illustrated in FIGS. 5A-5E are meant as an example of a situation where the wellbore tool 112 can be used. In other situations, slight differences in the procedure can occur without departing from this discloser. In the illustrated example, the first wellbore tubular 108 is a seal stinger that has become stuck within a PBR. The wellbore tool 112 is being deployed to create a vertical (longitudinal) cut to weaken the seal stinger 108 and allow for easier removal. While illustrated in the context of a vertical wellbore for simplicity, the tools and methods described herein are applicable to horizontal and deviated wellbores as well.

At 402, a wellbore tool 112 is received by a downhole tubular, such as the seal stinger 108, as shown in FIG. 5A. In instances where the wellbore 102 is deviated, horizontal, or simply difficult to traverse, the wellbore tool 112 may be pulled by an electric wellbore tractor 222 (not shown) into first the downhole tubular 108. Once the wellbore tool 112 has reached a target depth, in this case near the downhole end of the seal stinger 108, the wellbore tool extends actuable slips 208 to centralize and support the wellbore tool 112 within the seal stinger 108. This step is shown in FIG. 5B.

At 404, the wellbore tool 112 rotates the rotating blade 206. At 406, the rotating blade 206 is extended sufficiently from the wellbore tool 112 to cut through the downhole tubular 108. This step is shown in FIG. 5C.

At 408, as shown in FIG. 5D, the rotary cutting blade 206 cuts through the seal stinger 108. The cut is performed by translating the rotary cutting blade 206 vertically (longitudinally) while the rotary cutting blade 206 is rotating and extended through a wall of the seal stinger 108. As illustrated, translating the rotary cutting blade 206 vertically includes translating the rotary cutting blade 206 in an uphole direction. In some implementations, the rotary cutting blade 206 can be cycled to translate vertically in an uphole and downhole direction.

Once cutting operations are completed, the rotary cutting blade 206 is retracted into the wellbore tool 112 and the rotation of the rotary cutting blade 206 is ceased. Then, as illustrated in FIG. 5E, the actuable slips 208 are retracted and the wellbore tool 112 is retreated from the downhole tubular 108. In instances when a wellbore tractor 222 is used, the wellbore tractor 222 can be received simultaneously with the wellbore tool 112. Throughout the operation, the wellbore tool 112 can be receiving power from a topside facility 106 through the e-line 204.

Once the wellbore tool 112 is retrieved, the seal stinger 108 can be removed from the wellbore 102 because the longitudinal cut produced by the wellbore tool 112 has structurally weakened the seal stinger 108 around its circumference. This weakened portion can be deformed sufficiently to reduce friction forces or interferences that cause the stinger to be stuck within the PBR.

While the wellbore tool has been primarily described for removing stuck tubulars from a PBR, the wellbore tool describe herein can be used for other downhole activities without departing from this disclosure. For example, the wellbore tool can be used to cut multiple slots into liners of casing string to establish circulation.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

We claim:

1. A wellbore tool comprising:

a main body having a diameter such that the main body can be inserted into a wellbore; and a cutting assembly housed within the main body, comprising:

a rotary blade mounted vertically within the main body;

a blade motor coupled directly to the rotary blade, the blade motor configured to rotate the rotary blade with sufficient speed and torque to cut through a wellbore tubular, the blade motor supported by a blade motor mount;

a lead screw coupled to the blade motor mount, the blade motor mount defining a mating profile to receive the lead screw, the profile including an interference in a vertical direction to support the blade motor mount to the lead screw, the lead screw rotatable to control a vertical position of the rotary blade;

a lead screw motor rotably coupled to the lead screw, the lead screw motor configured to rotate the lead screw to adjust the vertical position of the rotary blade; and a guide located within the main body, the guide comprising a guide profile substantially trapezoidal in shape, having a tapered end at both an uphole end and a downhole end of the guide, that controls a horizontal position of the blade based on the vertical position of the rotary blade.

2. The wellbore tool of claim 1, wherein the blade motor and the lead screw motor are electric motors.

3. The wellbore tool of claim 1, wherein a speed of the rotary blade and rotary blade motor are configured to perform a cold-cut on carbon steel.

4. The wellbore tool of claim 1, wherein the wellbore tool is powered by an e-line running between the main body and a topside facility.

5. The wellbore tool of claim 1, wherein the guide profile substantially comprises a trapezoidal shape.

6. The wellbore tool of claim 1, further comprising:

actuable slips positioned at an end of the main body, the actuable slips configured to centralize and support the main body when in an extended state.

7. A method comprising:

receiving a wellbore tool by a downhole tubular, the wellbore tool comprising a rotary blade coupled directly to a blade motor, a lead screw rotatable to control a vertical position of the rotary blade; a guide located within the main body, the guide comprising a guide profile substantially trapezoidal in shape, having a tapered end at both an uphole end and a downhole end of the guide, that controls a horizontal position of the blade based on the vertical position of the rotary blade;

rotating the rotary blade by the blade motor coupled directly to the rotary blade;

extending the rotary blade from the wellbore tool, the rotary blade being extended sufficiently to cut through the downhole tubular; and cutting through the tubular.

8. The method of claim 7, further comprising translating the rotary blade vertically while cutting through the tubular.

9. The method of claim 8, wherein translating the rotary blade vertically comprises translating the rotary blade in an uphole direction.

10. The method of claim 8, wherein translating the rotary blade vertically comprises cycling the rotary blade in an uphole and downhole direction.

11. The method of claim 7, further comprising:

retracting the rotary blade into the wellbore tool;

ceasing rotating the rotary blade; and retrieving the wellbore tool from the downhole tubular.

12. The method of claim 7, further comprising:

receiving power, by the wellbore tool, from a topside facility.

13. The method of claim 7, wherein receiving the wellbore tool comprises:

pulling, by an electric wellbore tractor, the wellbore tool into the downhole tubular.

14. The method of claim 13, wherein the wellbore is a horizontal or deviated wellbore.

15. The method of claim 14 comprising:

retrieving the wellbore tool and the electric wellbore tractor from the wellbore.

16. The method of claim 7, wherein the tubular comprises a seal stinger.

17. The method of claim 16, further comprising removing the seal stinger from the wellbore.

18. The method of claim 7, further comprising centralizing and supporting the wellbore tool by actuating actuable slips.

19. A wellbore tool system comprising:

a main body configured to be inserted into a wellbore;

an e-line connecting the main body to a topside facility, the e-line configured to transfer power between the main body and the topside facility; and a cutting assembly housed within the main body, the cutting assembly comprising:

a rotary blade arranged to produce vertical cuts;

a lead screw coupled to the rotary blade, the lead screw controlling a vertical position of the rotary blade;

an electric blade motor coupled directly to the rotary blade, the blade motor configured to rotate the rotary blade with sufficient speed and torque to cut through a wellbore tubular, the electric blade motor configured to receive power through the e-line;

an electric lead screw motor coupled to the lead screw, the lead screw motor configured to rotate the lead screw to adjust the vertical position of the rotary blade, the electric lead screw motor configured to receive power through the e-line; and a guide located within the main body, the guide comprising a guide profile substantially trapezoidal in shape, having a tapered end at both an uphole end and a downhole end of the guide, that controls a horizontal position of the rotary blade based on the vertical position of the rotary blade.

20. The wellbore tool system of claim 19, further comprising:

an electric tractor connected to a downhole end of the main body, the electric tractor configured to receive power through the e-line.

* * * * *